US008522469B2

(12) United States Patent
Baker

(10) Patent No.: US 8,522,469 B2
(45) Date of Patent: Sep. 3, 2013

(54) RAIL MOUNT

(76) Inventor: Nathan Baker, Springfield, MO (US)

( * ) Notice: Subject to any disclaimer, the term of this patent is extended or adjusted under 35 U.S.C. 154(b) by 0 days.

(21) Appl. No.: 13/293,976

(22) Filed: Nov. 10, 2011

(65) Prior Publication Data

US 2013/0118051 A1 May 16, 2013

(51) Int. Cl.
*F41A 15/00* (2006.01)

(52) U.S. Cl.
USPC ..... 42/90; 42/124

(58) Field of Classification Search
USPC ..... 42/90, 124
See application file for complete search history.

(56) References Cited

U.S. PATENT DOCUMENTS 3,259,986 A * 7/1966 Carr ..... 42/124
3,834,052 A * 9/1974 Steck, III ..... 42/90
3,875,675 A * 4/1975 Krisay ..... 42/127
3,986,285 A * 10/1976 Krisay ..... 42/127
4,085,511 A * 4/1978 Kovac ..... 42/126
4,174,581 A * 11/1979 Castellano ..... 42/124
4,418,487 A * 12/1983 Strahan ..... 42/125
4,455,776 A * 6/1984 Ashley et al. ..... 42/124
5,926,964 A * 7/1999 Korapaty ..... 42/124
5,941,006 A * 8/1999 Horton ..... 42/124
6,722,074 B1 * 4/2004 Farrell ..... 42/124
6,886,288 B1 * 5/2005 Yocum et al. ..... 42/127
2003/0056417 A1 * 3/2003 Horton ..... 42/124
2007/0186459 A1 * 8/2007 Horton ..... 42/127
2011/0225865 A1 * 9/2011 Williams ..... 42/90

* cited by examiner

*Primary Examiner* — Michelle Clement
(74) *Attorney, Agent, or Firm* — Lathrop & Gage LLP

(57) ABSTRACT

An accessory mount for a gun is described having an attachment plate, a rail and a deflector plate for deflecting cartridge cases ejected from the gun. The deflector plate is mounted on an arm for positioning the deflector plate between the ejection port on the receiver of the gun and the rail on the accessory mount.

8 Claims, 7 Drawing Sheets

RAIL MOUNT

BACKGROUND

1. Field of the Invention

The rail mount described herein is in the field of accessories for firearms. More specifically the rail mount is in the field of mounts for securing accessories to a firearm, including scopes, lights and other types of optics for firearms, among others. The rail mount is suitable for use with firearms with actions that eject cartridge cases from the top of a gun in an upward direction.

2. Description of the Related Art

Scope mounts utilizing rails are commonly used. Some rail mounts have been used for top-ejecting firearms. However, the rail mount described herein provides improved isolation of mounted accessories from the impact and dislocation caused by the impact of top-ejecting cartridge cases.

SUMMARY OF THE INVENTION

The accessory mount for a gun with a receiver comprises in embodiments an attachment plate for attaching to the receiver of the gun, a rail attached to the attachment plate, and a deflector plate attached to the attachment plate and positioned between the rail and the receiver of the gun; wherein a cartridge case ejected from the receiver of the gun is deflected away from the rail by the deflector plate. In another embodiment of the accessory mount the gun ejects the cartridge case from the top of the receiver. In additional embodiments of the accessory mount, the deflector plate is attached to the attachment plate by an arm. The arm maintains a gap between the deflector plate and the rail. In other embodiments of the accessory mount, the arm absorbs a portion of the kinetic energy of the cartridge case ejected by the gun to reduce vibration of the rail.

DETAILED DESCRIPTION

Many guns are utilized with the addition of a scope to allow more accurate shooting over long distances. Other accessories may be added onto guns for various purposes. While many guns are provided with attachment points for scopes and other accessories, some guns are not provided by their manufacturer with attachment points. The rail mount described herein provides an improved attachment point on a gun for various accessories. The rail mount described herein provides a top mounting system for top-ejecting guns. The embodiment depicted in the figures attached hereto may be attached to an SKS semi-automatic rifle, though this and other embodiments of the rail mount may attach to other rifles or guns within the scope of the disclosed invention.

Figure 1:
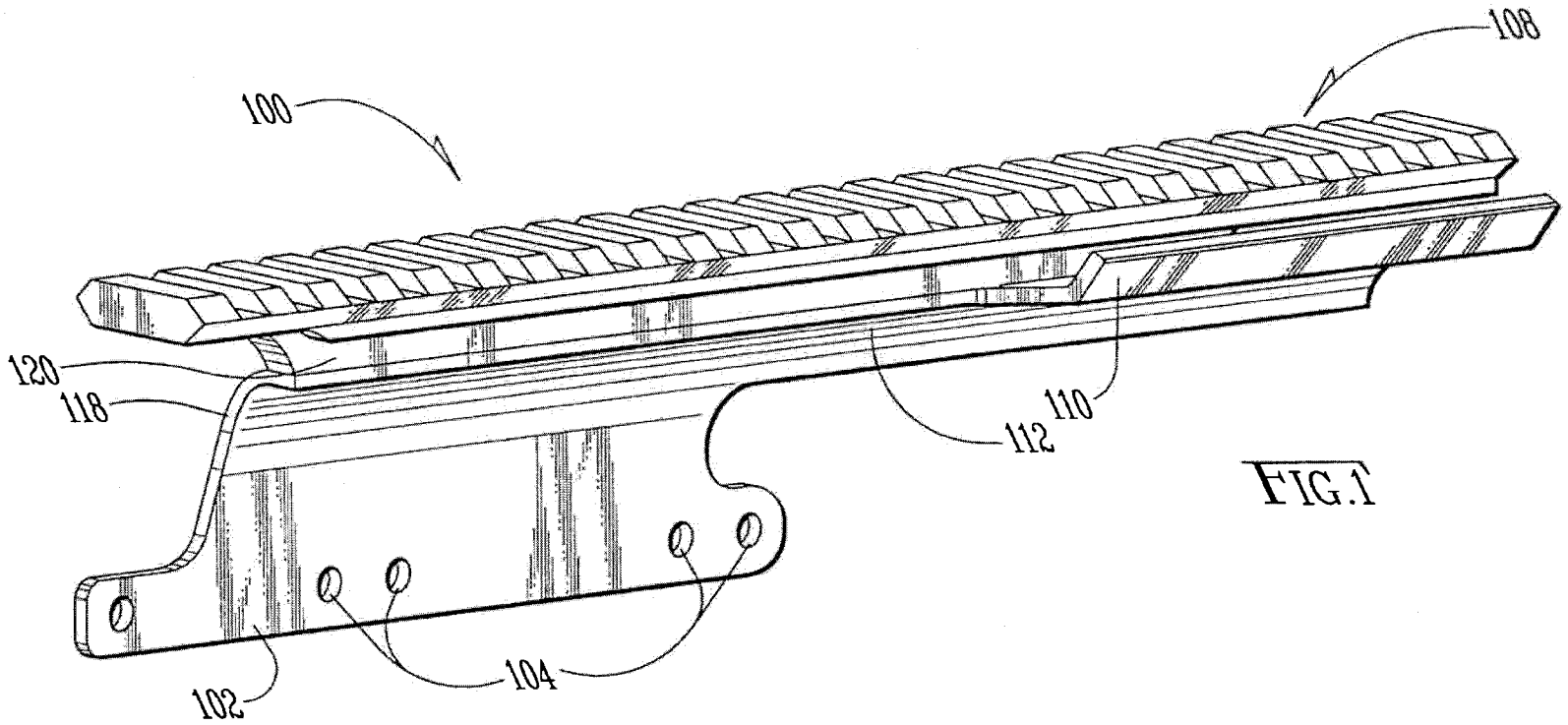
FIG. 1 is a perspective view of an embodiment of the rail mount.

Referring now to FIG. 1, a perspective view of an embodiment of the rail mount is depicted. The rail mount 100 is provided with mounting plate, or attachment plate, 102 for attaching the rail mount 100 to a gun. The mounting plate 102 is provided with a means of securing and releaseably attaching the rail mount 100 to a gun. In the embodiment depicted in the figures, the means of attachment comprise a plurality of mounting holes 104 for receiving machine screws or bolts to secure the mounting plate 102 to the receiver block of the gun. Other means of releaseable and secure attachment may be utilized within the scope of the rail mount described herein.

The mounting plate 102 extends vertically up from the side of the receiver block of the gun, and connects to the rail assembly 106 located above the receiver block. In the embodiment shown in the figures, the mounting plate 102 curves to a horizontal orientation at the connection point with the rail assembly 106. In other embodiments, the mounting plate may be formed into other shapes with equal efficacy. For example, in alternative embodiments of the rail mount 100, the mounting plate may extend only vertically before connection to the rail assembly 106, it may contain a right angle member to connect to the rail assembly 106, or it may contain several discrete bends or angular joints to bring it to a horizontal connection with the rail assembly 106. Other designs for the mounting plate 102 may be utilized within the scope of the invention described herein.

Rail assembly 106 incorporates a rail 108 and deflector 110. The rail 108 is provided with attachment points for various accessories. In the embodiment depicted in the figures, the rail 108 has a rail geometry known as the U.S. military standard MIL-STD-1913 rail or Picatinny rail. Other geometries, attachment means or rail designs may be utilized in alternative embodiments of the rail mount 100 within the scope of the disclosed invention. The rail 108 extends the length of the mounting plate 102 and may extend significantly forward from the mounting plate 102, along the barrel of the gun. In some embodiments of the rail mount 100, the rail may extend behind the mounting plate 102.

When the rail mount 100 is installed on a gun, deflector 110 is located above the ejection port of the gun. Depending on the location of the ejection port of the gun in relation to the attachment point of the rail mount 100, deflector 110 may be supported by an arm 112 so that the deflector is positioned at the appropriate position beneath rail 108.

The rail mount 100 may comprise a variety of the components attached together by screws, bolts, welding, or other attachment mechanisms known in the art of joining components. The rail mount 100 may also be formed as a single piece by extrusion, bending from sheet metal, machining, casting, injection molding or other similar process. If rail mount 100 is formed from multiple components the varying components may be manufactured in different manners as best suited for the component. The embodiment depicted in the figures may be formed from an aluminum alloy, such as 6061-T4, however, the rail mount 100 might in embodiments be formed from steel, composite materials or other materials with the strength and rigidity necessary for the rail mount 100.

Figure 2:
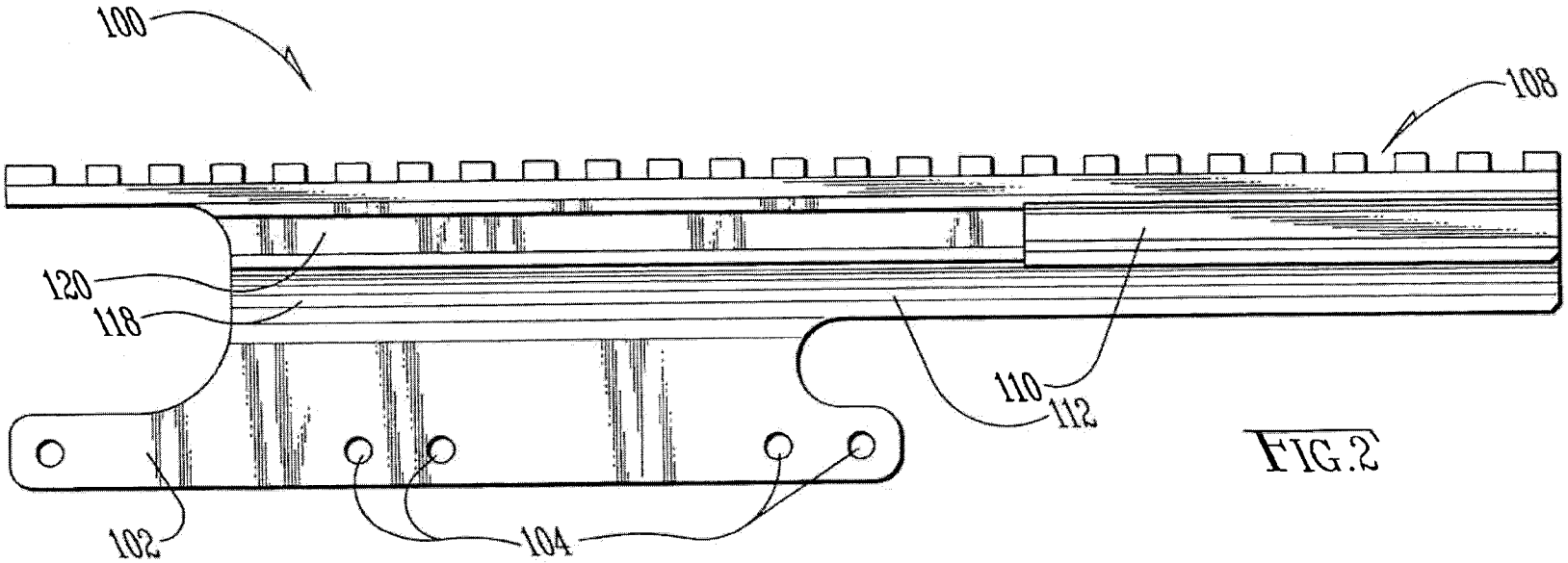
FIG. 2 is a side view of an embodiment of the rail mount.
Figure 3:
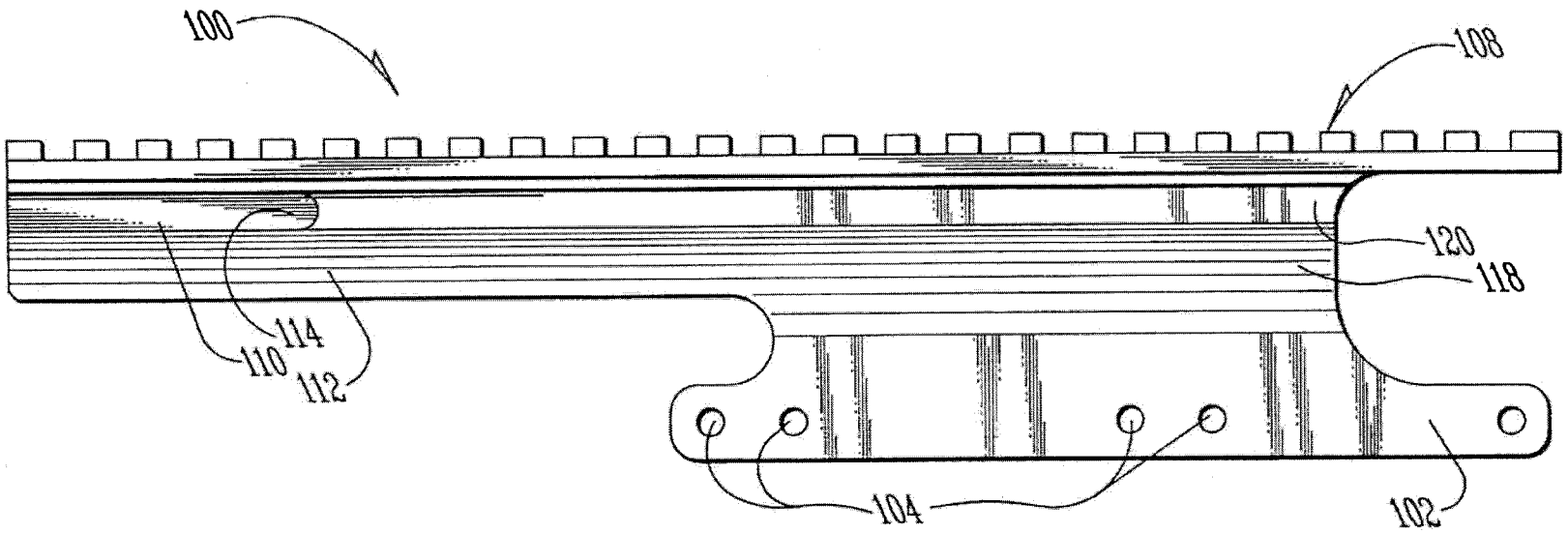
FIG. 3 is a side view of an embodiment of the rail mount.

Referring now to FIGS. 2 and 3, side views of an embodiment of the rail mount 100 are depicted. The arm 112 supporting deflector 110 holds the deflector a slight distance beneath rail 108 maintaining gap 114 between the rail and deflector. The gap 114 is substantially uniform along the length of deflector 110 in the embodiment depicted in the figures, though in other embodiments it may vary along the length thereof As will be seen in relation to a later figure, the gap 114 widens across the width of deflector 114 due to the angle at which deflector 110 is disposed in relation to the bottom surface of rail 108.

The specific shape of mounting plate 102 and mounting holes 104 may change depending on the gun for which a specific embodiment of the rail mount 100 is designed. The location of the mounting holes 104 and exact shape of mounting plate 102 are not limiting of the rail mount invention.

Figure 4:
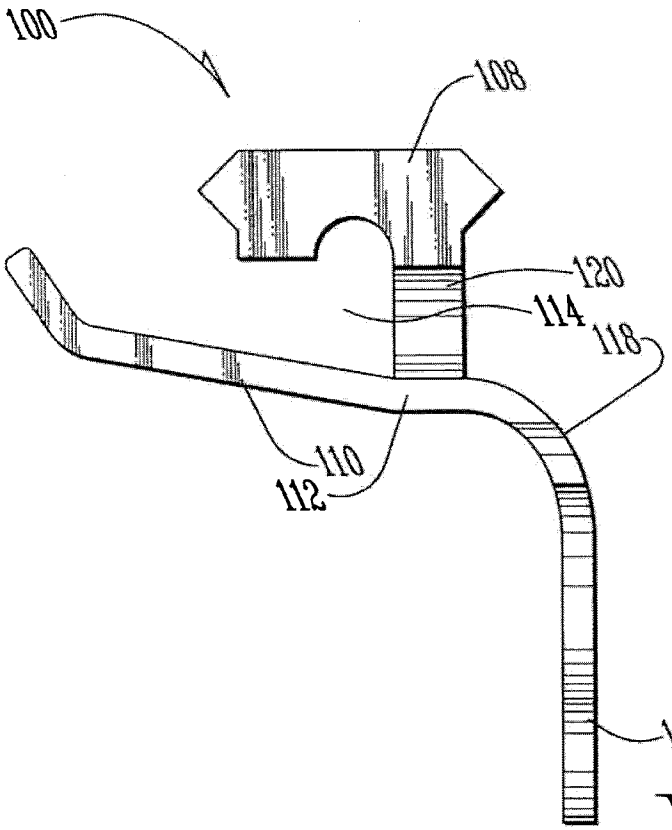
FIG. 4 is an end view of an embodiment of the rail mount.

Referring now to FIG. 4, an end view of an embodiment of the rail mount 100 is depicted. The view is from the end of the rail mount 100 adjacent to the deflector 110 as though the viewer is looking down the barrel of the gun on which the rail mount is attached. In the embodiment depicted in this figure mounting plate 102 curves at bend 118. In other embodiments, a right-angle may be utilized instead of a curve, or mounting plate 102 may extend vertically with the deflector 110 and rail assembly 106 attached to the vertical mounting plate 102.

The rail assembly 106 connects to the mounting plate 102 by a rail support 120. The height of rail support member 120 secures rail 108 at the desired height above the gun, and in conjunction with the shape of the deflector 110, defines the shape and width of the gap 114 between the deflector 110 and the rail 108.

Referring again to FIG. 4, the deflector 110 extends from its attachment to mounting plate 102 at a slightly upward angle. The angle of the deflector 110 causes an ejecting cartridge case to deflect in the direction away from the mounting plate 102. This prevents the cartridge case from impacting the bottom of the rail 108 causing vibration of the scope or other accessories installed on rail 108. The deflector 110 is attached to the mounting plate 102 by arm 112. The arm 112 provides a limited amount of flexibility to the deflector 110 so that the deflector 110 can absorb some of the energy of the ejecting cartridge case through flexing of deflector 110 or arm 112. This energy absorption by the arm prevents that energy from dislocating or vibrating the accessories mounted on rail 108. Therefore, scopes or other optical accessories mounted on rail 108 remain accurately and correctly adjusted to the gun despite continued use and ejection of shells.

Figure 5:
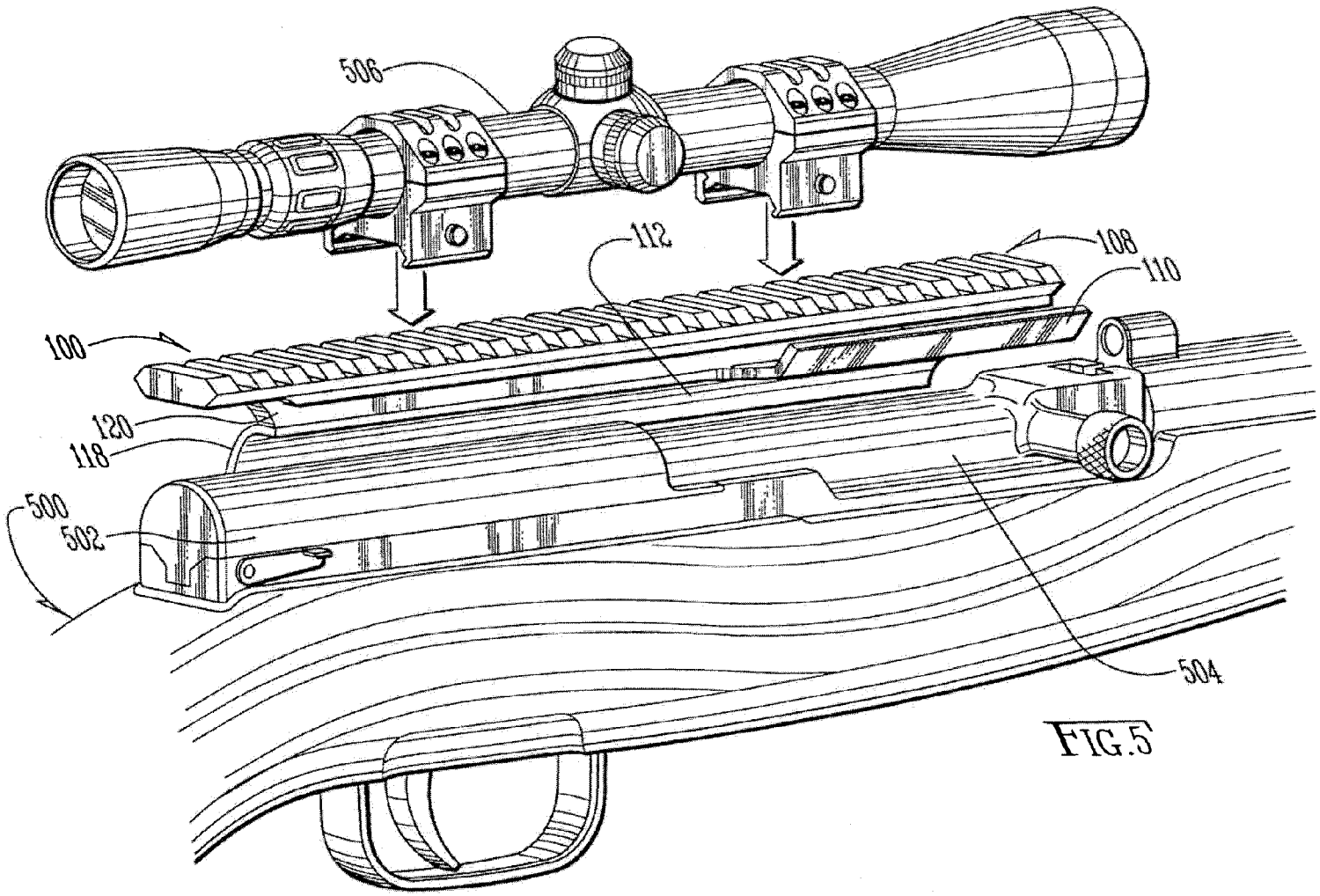
FIG. 5 is a perspective view of an embodiment of the rail mount attached to a gun.

Referring now to FIG. 5, a side view of an embodiment of mount 100 attached to gun 500 is depicted. The mounting plate 102 extends upward from the opposite side of receiver 502 positioning rail 108 parallel to gun 500. The deflector 110 is positioned above bolt or slide 504 so that when a cartridge case ejects from receiver 502 it impacts deflector 110 and is ejected to the side instead of straight up into the rail 108. Once mount 100 is attached to the gun 500, a scope 506 or other similar accessory may be attached to rail 108 by mounting points adapted to the rail geometry provided in that specific embodiment.

Figure 6:
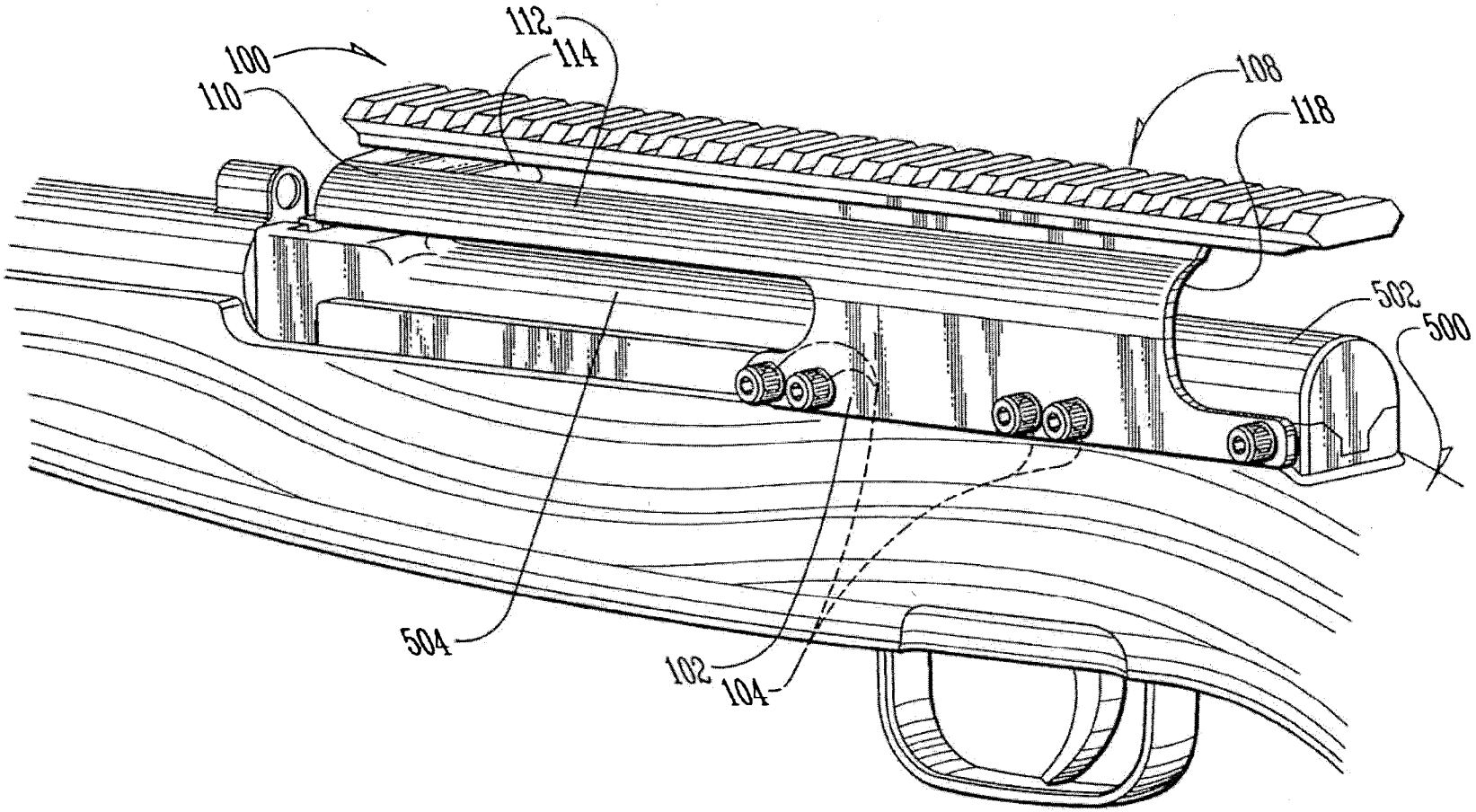
FIG. 6 is a perspective view of an embodiment of the rail mount attached to a gun.

Referring now to FIG. 6, a side view of an embodiment of mount 100 attached to gun 500 is depicted. This view depicts the gun from the opposite side as shown in FIG. 5. In this view, mount 100 is attached to the receiver 502 by bolts or machine screws inserted through holes 104 and secured in threaded holes in receiver 502. On some guns 500 pre-existing holes may be provided in the receiver 502, however for some guns 500 it may be necessary to drill and tap holes in the receiver. In this view the positioning of the deflector 110 over the ejection port of the receiver 502 can be seen.

Figure 7:
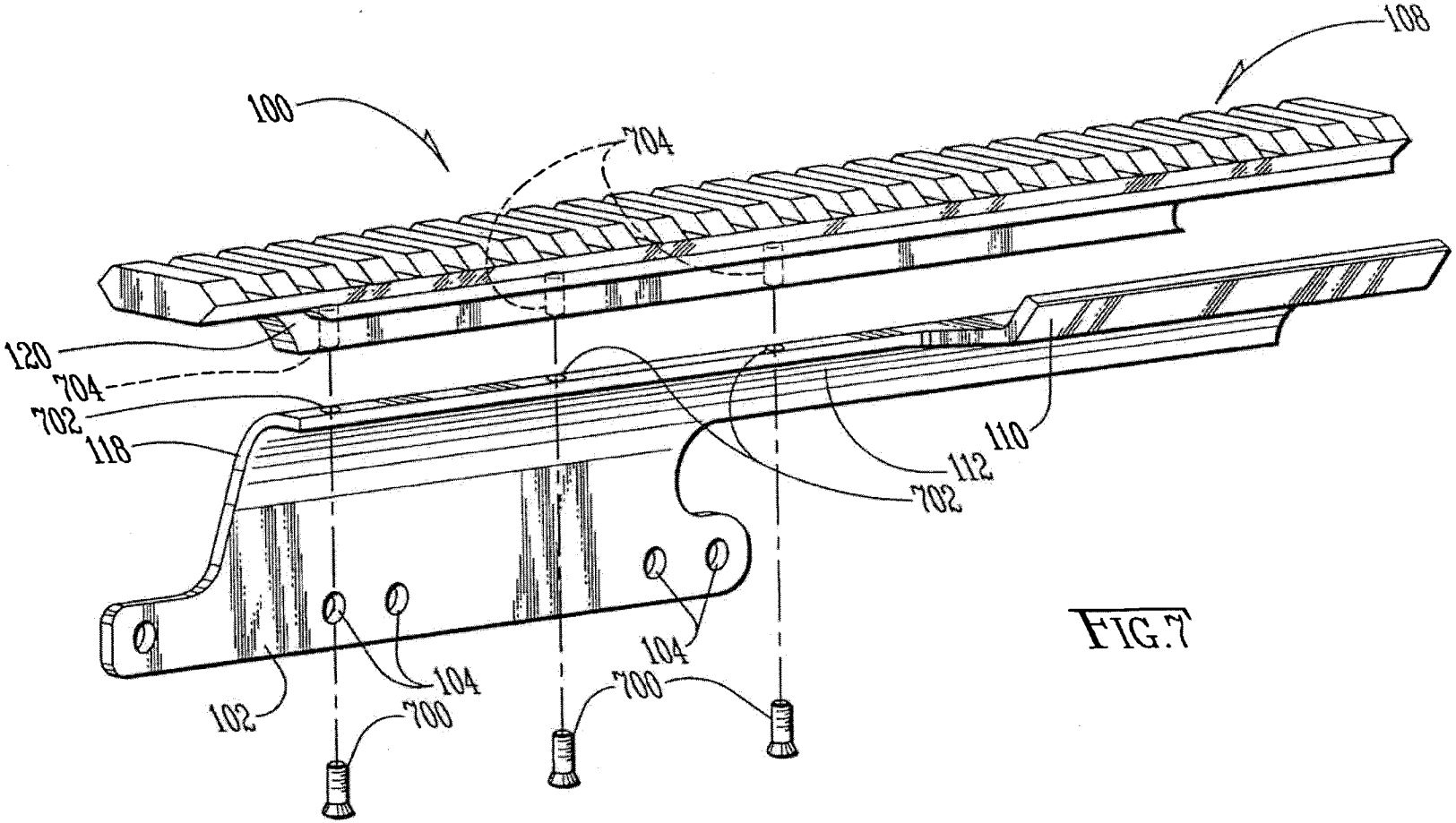
FIG. 7 is an exploded view of an embodiment of the rail mount.

Referring now to FIG. 7, an exploded view of an embodiment of the rail mount 100 is depicted. In this embodiment of the rail mount 100, the rail assembly 106 is manufactured as a separate component from mounting plate 102. In the depicted embodiment, the rail assembly 106 is attached to the mounting plate 102 by screws or bolts 700. Screws 700 are inserted through holes 702 in mounting plate 102 into threaded holes 704 in rail support 120.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An accessory mount for a top-ejecting gun comprising:

A mounting plate for attaching the accessory mount, the mounting plate having a first end and a second end, said first end of the mounting plate provided with mounting holes for securing the mounting plate to a gun;

a rail having a plurality of attachment points for accessories, said rail having a first and a second end, the first end thereof attached to the mounting plate adjacent to the first end of the mounting plate and extending in a perpendicular direction from the mounting plate;

a deflector plate, having a first and a second end, the first end thereof attached to the mounting plate at a point between the first end and the second end of the mounting plate, the deflector plate extending from the mounting plate substantially parallel to and separated from the rail.

2. The accessory mount of claim 1 wherein the deflector plate is attached to the mounting plate by an arm.

3. An accessory mount for a gun with an ejection port comprising:

an attachment plate for attaching to a gun, the attachment plate having a first end and a second end, said second end being provided with mounting holes for attaching the attachment plate to a gun;

a rail having a plurality of attachment points for accessories, said rail attached to the attachment plate adjacent to the first end thereof;

a deflector plate attached to the attachment plate between the rail and the second end thereof;

wherein the rail extends in a direction perpendicular to the mounting plate; and wherein the deflector plate is disposed substantially parallel to and separated from the rail.

4. The accessory mount of claim 3 wherein the deflector plate is attached to the attachment plate by an arm.

5. The accessory mount of claim 2 wherein the plane of the deflector plate is disposed at an angle to the rail.

6. The accessory mount of claim 5 wherein the arm and the deflector plate are formed from flexible materials.

7. The accessory mount of claim 4 wherein the plane of the deflector plate is disposed at an angle to the rail.

8. The accessory mount of claim 7 wherein the arm and the deflector plate are formed from flexible materials.

* * * * *